US008049769B2

(12) United States Patent
Nakanishi et al.

(10) Patent No.: US 8,049,769 B2
(45) Date of Patent: Nov. 1, 2011

(54) THERMAL PRINT HEAD AND THERMAL PRINTER PROVIDED WITH WIRELESS COMMUNICATION FUNCTION USING SUCH THERMAL PRINT HEAD

(75) Inventors: Masatoshi Nakanishi, Kyoto (JP); Hiroyuki Maeda, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 765 days.

(21) Appl. No.: 11/887,849

(22) PCT Filed: Apr. 3, 2006

(86) PCT No.: PCT/JP2006/307027

§ 371 (c)(1),
(2), (4) Date: Oct. 4, 2007

(87) PCT Pub. No.: WO2006/109601

PCT Pub. Date: Oct. 19, 2006

(65) Prior Publication Data

US 2009/0009578 A1 Jan. 8, 2009

(30) Foreign Application Priority Data

Apr. 6, 2005 (JP) ..... 2005-109792

(51) Int. Cl.
*B41J 2/32* (2006.01)

(52) U.S. Cl. ..... 347/171

(58) Field of Classification Search ..... None
See application file for complete search history.

(56) References Cited

U.S. PATENT DOCUMENTS

| | | | | |
|---|---|---|---|---|
| 4,567,489 | A * | 1/1986 | Obstfelder et al. | 347/208 |
| 6,246,326 | B1 | 6/2001 | Wiklof et al. | |
| 6,857,714 | B2 * | 2/2005 | Hohberger et al. | 347/2 |
| 2002/0015066 | A1 * | 2/2002 | Siwinski et al. | 347/19 |
| 2004/0113971 | A1 * | 6/2004 | Nakajima | 347/29 |
| 2004/0223029 | A1 * | 11/2004 | Nishino | 347/33 |
| 2005/0058483 | A1 | 3/2005 | Chapman et al. | |

FOREIGN PATENT DOCUMENTS

| | | |
|---|---|---|
| EP | 1 422 656 | 5/2004 |
| JP | 63-28676 | 2/1988 |
| JP | 2003-132330 | 5/2003 |
| JP | 2004-1351 | 1/2004 |
| JP | 2005-6263 | 1/2005 |

OTHER PUBLICATIONS

European Search Report from the corresponding EP 06 73 0975, mailed Mar. 18, 2008.
International Search Report from the corresponding PCT/JP2006/307027, mailed May 16, 2006.

* cited by examiner

*Primary Examiner* — Manish S Shah
*Assistant Examiner* — Alexander C Witkowski
(74) *Attorney, Agent, or Firm* — Hamre, Schumann, Mueller & Larson, P.C.

(57) ABSTRACT

The thermal printhead (A1) performs printing on RFID tag (T) as a print target that includes a coil antenna and a memory. The thermal printhead includes a coil antenna (3) as a part of a data transmitter-receiver for the transmitting and receiving of data with respect to the RFID tag (T) by wireless communication.

16 Claims, 3 Drawing Sheets

THERMAL PRINT HEAD AND THERMAL PRINTER PROVIDED WITH WIRELESS COMMUNICATION FUNCTION USING SUCH THERMAL PRINT HEAD

TECHNICAL FIELD

The present invention relates to a thermal printhead with wireless communication function, and also to a thermal printer with wireless communication function, using the thermal printhead.

BACKGROUND ART

Recently, automatic identification systems have been actively introduced for baggage management in airports. In the automatic identification systems, a device incorporating hardware and software automatically performs data reading and data identification with respect to a management target, without human operation. Specifically, some automatic identification systems use RFID (Radio Frequency IDentification) tags. The RFID tag includes a memory for recording identification data, and a coil antenna for data transmission by wireless communication, and its outer surface is printed with letters or barcodes corresponding to e.g. the identification data. Data transmission and printing to the RFID tag is performed by an RFID tag printer, for example.

FIG. 6 illustrates a conventional RFID tag printer (see Patent document 1, for example). The illustrated RFID tag printer X includes a thermal printhead 91 for printing on RFID tags 99, and two coil antennas 93A, 93B each serving as data transmitting and receiving means with respect to the RFID tags 99. The RFID tag printer X operates in the manner described below.

First, an external computer 94 sends identification data corresponding to each of the RFID tags 99 to a controller 96 via a communication I/F 95. Then, a sheet 98 provided with the RFID tags 99 is fed out of an RFID tag sheet roll 97. When each of the RFID tags 99 arrives at a position above the coil antenna 93A as seen in the figure, the controller 96 issues a command to cause the coil antenna 93A to generate electromagnetic field. When an antenna coil (not shown) of the RFID tag 99 is brought into the electromagnetic field, electrical power supply as well as transmission of identification data to be recorded are simultaneously performed to the RFID tag 99 by electromagnetic induction. In this way, corresponding identification data is recorded in the memory (not shown) of each RFID tag 99. Next, when the RFID tag 99 arrives at a position below the thermal printhead 91, the RFID tag 99 is held between the thermal printhead 91 and a platen roller 92. In this state, letters, marks, and barcodes corresponding to the identification data are printed on the RFID tag 99. When the RFID tag 99 arrives at a position above the antenna coil 93B, the identification data recorded in the memory (not shown) of the RFID tag 99 is sent to the controller 96 via the antenna coil 93B, utilizing electromagnetic induction. Then, the controller 96 checks the validity of the identification data recorded in the RFID tag 99. In this way, the RFID tag printer X performs printing and data transmission relative to the RFID tag 99.

However, such RFID tag printer X has problems as described below.

Firstly, in the RFID tag printer X, the thermal printhead 91 and the antenna coils 93A, 93B are arranged in series in the feeding direction of the RFID tag 99. In order to prevent the antenna coils 93A, 93B and the platen roller 92 from interfering with each other, the thermal printhead 91 needs to be spaced from the antenna coils 93A, 93B. Thus, the thermal printhead 91 and the antenna coils 93A, 93B need a large space for installation, which prevents downsizing of the RFID tag printer X.

Secondly, the intensity of the electromagnetic field generated by the antennal coils 93A, 93B becomes weaker as proceeding further from the antenna coils 93A, 93B. In order to properly perform data transmission with the RFID tag 99, the RFID tag 99 is required to pass through an area in the electromagnetic field having the minimum operating magnetic intensity. By performing data transmission within an area with high magnetic intensity, reliable and high-speed data transmission is performed. Thus, it is preferable that the antenna coils 93A, 93B are positioned as close to the RFID tag 99 as possible. However, the RFID tag printer X has room for improvement in positioning the antenna coils 93A, 93B closer to the RFID tag 99 without contacting each other.

Patent Document: JP-A-2003-132330

DISCLOSURE OF THE INVENTION

Object of the Invention

The present invention has been proposed under the above-described circumstances. An object of the invention is to provide a compact thermal printhead and a compact thermal printer with wireless communication function, capable of reliable and high-speed data transmission.

Means for Obtaining the Object

To obtain the above object, the present invention has adopted the following technical measures.

A first aspect of the present invention provides a thermal printhead for printing on a print target including a coil antenna and a memory. The printhead comprises a data transmitter-receiver for performing data communication with respect to the print target by wireless communication. The wireless communication in the present invention means communication performed without using electrical wires, and this can be achieved by electromagnetic induction and radio waves, for example.

Preferably, the data transmitter-receiver includes a coil antenna.

Preferably, the data transmitter-receiver further includes a drive IC for the coil antenna.

Preferably, the data transmitter-receiver performs data communication with the print target which is an RFID (Radio Frequency Identification) tag.

Preferably, the thermal printhead further comprises a substrate and a plurality of heating resistors arranged on the substrate, where the coil antenna is provided at the substrate.

Preferably, the coil antenna is provided on a surface of the substrate on which the heating resistors are provided.

Preferably, the coil antenna is provided on a surface of the substrate which is opposite to the surface provided with the heating resistors.

Preferably, the thermal printhead further comprises a magnetic sheet containing a magnetic substance.

Preferably, the magnetic substance is ferrite.

Preferably, the magnetic sheet is provided at a side reverse to a side facing the print target via the coil antenna.

A second aspect of the present invention provides a thermal printer with wireless communication function. The thermal printer comprises a thermal printhead according to the first aspect, to perform printing on the print target and to perform data communication with the print target.

Other features and advantages will be apparent from the following description with reference to the accompanying drawings.

BEST MODE FOR CARRYING OUT THE INVENTION

Preferred embodiments of the present invention will be described below with reference to the accompanying drawings.

Figure 1:
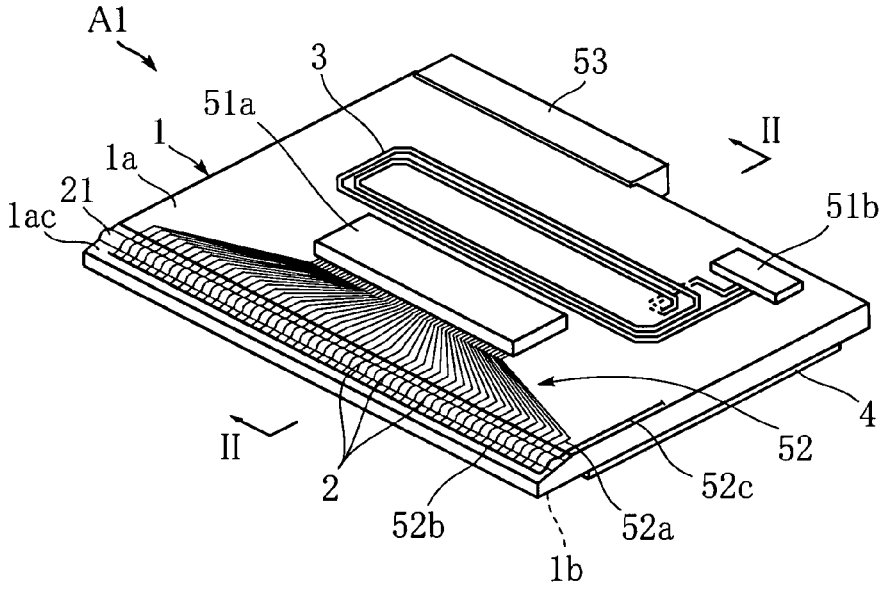
FIG. 1 is an overall perspective view illustrating a thermal printhead according to a first embodiment of the present invention.
Figure 2:
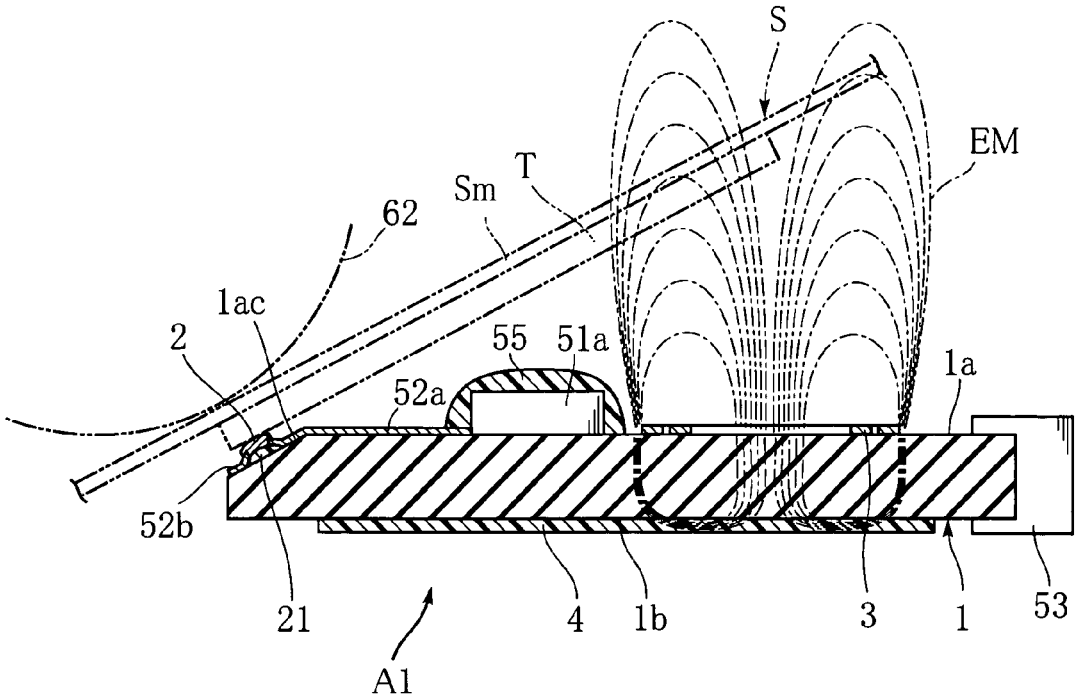
FIG. 2 is a sectional view taken along lines II-II in FIG. 1.

FIGS. 1 and 2 illustrate a first embodiment of thermal printhead according to a first aspect of the present invention. The thermal printhead A1 includes a substrate 1, a plurality of heating resistors 2, a coil antenna 3, a magnetic sheet 4, drive ICs 51*a*, 51*b*, and a connector 53. As described below, the thermal printhead A1 is to be incorporated in e.g. an RFID tag printer through the connector 53, and performs the printing on RFID tags as well as the transmitting and receiving data with respect to the RFID tags. Note that a sealing resin 55 illustrated in FIG. 2 is not shown in FIG. 1.

Figure 3:
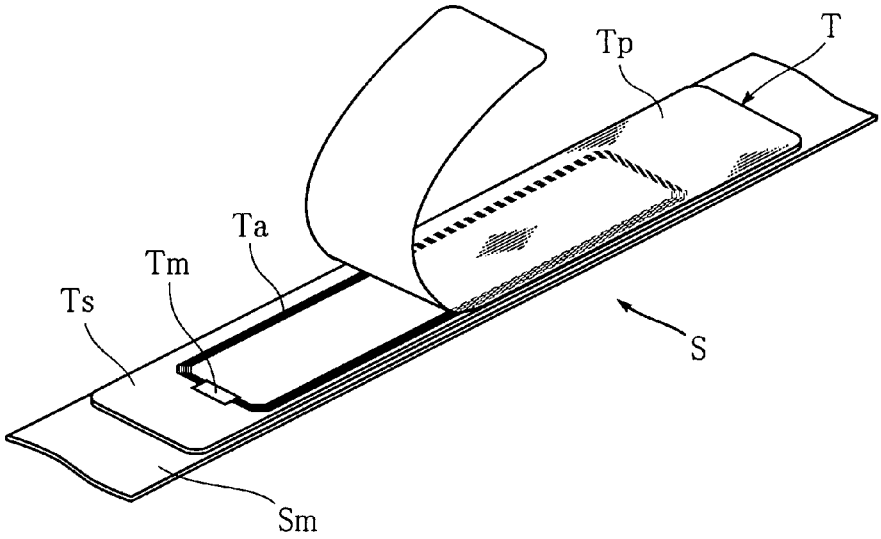
FIG. 3 is an overall perspective view illustrating an example of an RFID tag.

The RFID tag, which is an example of the print targets of the thermal printhead A1, will be described. FIG. 3 illustrates an example of RFID tag. The illustrated RFID tag T, including a memory Tm, a coil antenna Ta, a print sheet Tp, and an adhesive sheet Ts, is used as a baggage management tag at an airport, for example. The RFID tag T is supplied from an RFID tag sheet S consisting of a plurality of RFID tags arranged on a mount Sm, for example. The memory Tm electronically stores identification data for baggage management, for example. The coil antenna Ta is used for performing the transmitting and receiving of data with respect to the thermal printhead A1 by wireless communication. The print sheet Tp is a resin sheet or a paper strip containing thermal coloring particles for printing letters, marks, and barcodes corresponding to the above identification data. The adhesive sheet Ts is used to attach the RFID tag T to e.g. a piece of baggage. In data communication with the RFID tag T, in conformity to the Radio Law, a frequency of 13.56 MHz is assigned for wireless communication, for example. The wireless communication at this frequency band is performed by electromagnetic induction method. For performing the printing and the data transmission with respect to the above-described RFID tag T, the thermal printhead A1 is designed as described below.

The substrate 1 is an insulating substrate made of e.g. alumina ceramic, and as shown in FIG. 1, is rectangular as seen in plan view. The obverse surface 1*a* of the substrate 1 includes an inclined portion 1*ac* at its one end. As shown in FIG. 2, with the inclined portion 1*ac*, the thermal printhead A1 is positioned at an inclined posture relative to the RFID tag as a print target.

The inclined portion 1*ac* of the obverse surface 1*a* is provided with the heating resistors 2. The heating resistors 2 heat the print target by resistance heat for perform printing. The heating resistors 2 are made by printing and baking thick-film resistive paste containing ruthenium oxide, for example. The heating resistors 2 are aligned in the primary scanning direction of the thermal printhead A1. In the present embodiment, the heating resistors 2 are provided on a glazed portion 21 of the inclined portion 1*ac*. The glazed portion 21 is made of glass and is arcuate as seen in section, so that the heating resistors 2 protrude from the inclined portion 1*ac*. As shown in FIG. 2, for proper heat transmission from the heating resistors 2 to the RFID tag T, the RFID tag T is pressed onto the heating resistors 2 using a platen roller 62, for example.

A wiring 52 is made of highly conductive Au film by printing and baking resinated Au. As shown in FIG. 1, the wiring 52 includes a plurality of individual electrodes 52*a*, a common electrode 52*b*, and a common line 52*c*.

The individual electrodes 52*a* electrically connect the heating resistors 2 and the drive IC 51*a*. As shown in FIG. 2, one end of each of the individual electrodes 52*a* overlaps with a respective one of the heating resistors 2. As shown in FIG. 1, the common electrode 52*b* includes a portion extending in the primary scanning direction and a plurality of portions extending in the secondary scanning direction perpendicular to the primary scanning direction. As shown in FIG. 2, each of the portions extending in the secondary scanning direction partly overlaps a respective one of the heating resistors 2. The common line 52*c* has one end connected to the common electrode 52*b* and non-illustrated another end connected to the connector 53.

The drive IC 51*a* is internally formed with circuits for controlling the heat generation of the resistors 2 based on identification data transmitted from an external device (not shown). The drive IC 51*a* selectively applies electrical current to the heating resistors 2 via the individual electrodes 52*a*. In this way, the heating resistors 2 generate heat and printing is performed on the RFID tag. The drive IC 51*a* is covered by the sealing resin 55 for shock protection and electromagnetic shielding.

The coil antenna 3 and the drive IC 51*b* serve as a data transmitter-receiver in the present invention. The coil antenna 3 is made of Cu, for example, by forming Cu film on the obverse surface 1*a* and then performing patterning to the Cu film by etching. As shown in FIG. 2, when an electrical current is applied to the coil antenna 3, electromagnetic field EM is generated correspondingly to the direction and intensity of the current.

The drive IC 51*b* is internally formed with circuits for controlling the electromagnetic field EM generated by the coil antenna 3, based on identification data transmitted from an external device (not shown). The drive IC 51*b* generates the electromagnetic field EM at a frequency of e.g. 13.56 MHz, as described above. Further, the drive IC 51*b* may have functions not only to send the identification data but also to receive the identification data recorded in the RFID tag T. This data receiving function also utilizes electromagnetic induction method using the electromagnetic field EM.

As shown in FIG. 2, the magnetic sheet 4 prevents the electromagnetic field EM generated by the coil antenna 3 from extending below. The magnetic sheet 4 is a resin sheet containing ferrite powder as a magnetic substance, for example, and is provided at the reverse surface 1*b* of the substrate 1 in the present embodiment. The magnetic sheet 4 has a relatively high magnetic permeability, while having a relatively low electric loss. Thus, the electromagnetic field EM selectively passes through the magnetic sheet 4, and undue heat generation is prevented at the magnetic sheet 4. An example of such magnetic sheet 4 includes Flexield (Registered Trade Mark) manufactured by TDK Corporation.

Figure 4:
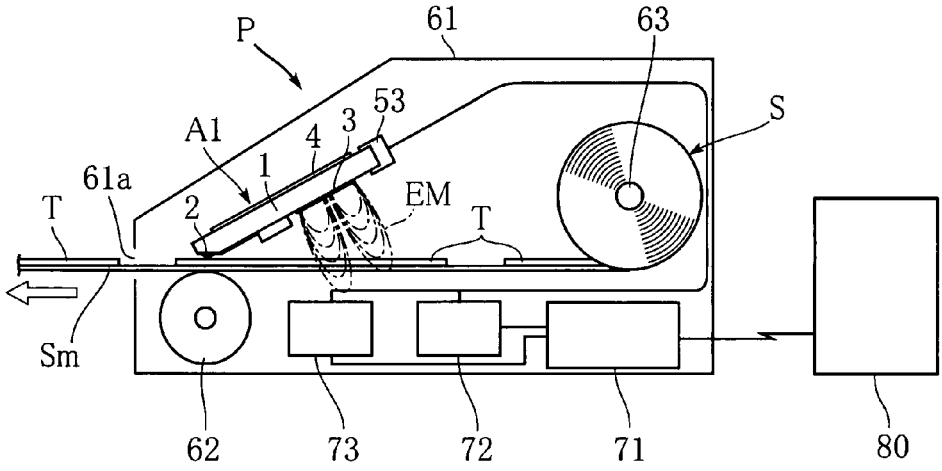
FIG. 4 is a sectional view illustrating an example of an RFID tag printer using the thermal printhead shown in FIG. 1.

FIG. 4 illustrates an example of a thermal printer with wireless communication function, incorporating the thermal printhead A1. The illustrated RFID tag printer P includes a housing 61, the thermal printhead A1, a platen roller 62, an RFID tag sheet feeder 63, and controllers 71, 72, 73. The RFID tag printer P performs the printing on the RFID tag T and the data transmitting and receiving with the RFID tag T, based on identification data transmitted from an external computer 80.

The housing 61, made of a resin for example, accommodates the thermal printhead A1, the platen roller 62, the RFID tag sheet feeder 63, and the controllers 71, 72, 73. The housing 61 is formed with an opening 61*a* through which the RFID tag sheet S is fed out of the printer.

The thermal printhead A1 is designed as described above with reference to FIGS. 1 and 2. In the RFID tag printer P, the thermal printhead A1 is held within the housing 61 at an inclined posture so that the heating resistors 2 face downward as seen in the figure.

The RFID tag sheet feeder 63 includes a drive shaft and a motor as a drive source. The drive shaft is configured to hold a roll of the RFID tag sheet S. By the drive force of the motor, the drive shaft rotates to feed the RFID tag sheet S toward the left side as seen in the figure. The RFID tag sheet S fed out is held by e.g. supporting rollers (not shown) provided in the housing 61, so that it extends in the horizontal direction in the figure.

The platen roller 62 is positioned below the thermal printhead A1, and serves to press the RFID tag T against the heating resistors 2. The platen roller 62 has its surface made of an appropriately soft resin or rubber, and is rotated by a drive motor (not shown).

In the bottom portion of the housing 61, three controllers 71, 72, 73 are incorporated. The controller 71 controls the entire operation of the RFID tag printer P. The functions of the controller 71 include data communication with the external computer 80, data communication with the controllers 72, 73, synchronous drive control of the platen roller 62 and the RFID tag sheet feeder 63. The controllers 72, 73, is connected to the thermal printhead A1 via the connector 53. The controller 72 controls the printing process of the thermal print head A1, and the controller 73 controls the wireless communication of the thermal printhead A1. For purposes of clarifying their respective functions, the controllers 71, 72, 73 are depicted as individual controllers. However, it may be arranged that only one controller is provided, which is capable of performing all the functions of the controllers 71, 72, 73. Further, any one of the functions may be assigned to the external computer 80, for example.

Next, how the RFID tag printer P performs the printing on the RFID tag T and the transmitting and receiving of data with respect to the RFID tag T will be described below.

First, identification data corresponding to each RFID tag T is sent from the external computer 80 to the controller 71. Then, the controller 71 issues a command to cause the RFID tag sheet feeder 63 to feed the RFID tag sheet S toward the left side in the figure. While the RFID tag sheet S is being fed, the tracking of the RFID tag T is performed by using a proximity sensor (not shown).

When the RFID tag T arrives at a position below the thermal printhead A1 as seen in the figure, the controller 72 issues a command to the thermal printhead A1, so that the thermal printhead A1 starts printing process. In the printing process, letters, marks, and barcodes corresponding to the identification data are printed on the print sheet Tp shown in FIG. 3.

When the above printing process starts, or before or after it stars, the controller 73 shown in FIG. 4 issues a command to the thermal printhead A1, to initiate the transmitting or receiving of data with respect to the thermal printhead A1. Then, electromagnetic field EM is generated by the coil antenna 3, and wireless communication with the coil antenna Ta shown in FIG. 3 is performed by the electromagnetic induction method. The electromagnetic field EM supplies the RFID tag T with electrical power for operation of the RFID tag T, while also transmitting identification data to the RFID tag T. As a result, identification data corresponding to each RFID tag T is recorded in the memory Tm of the RFID tag T. When the thermal printhead A1 or the RFID tag printer P is provided with data receiving function, the identification data recorded in the RFID tag T is received by the coil antenna 3 of the thermal printhead A1 immediately after the transmission of the identification data. Then, the accuracy of the identification data recorded in the RFID tag T is checked by e.g. the controller 73.

Thereafter, the RFID tags T are successively fed out from the opening 61*a*. The RFID tag T, undergone both the printing process and the recording of the identification data, is peeled off from the mount Sm by a user and attached to a piece of baggage as management target. The baggage with the RFID tag T, in cooperation with e.g. an RFID tag reader, facilitates the management at a starting airport, in an airplane, and at an arrival airport.

Next, the functions of the thermal printhead A1 and the RFID tag printer P will be described below.

Figure 6:
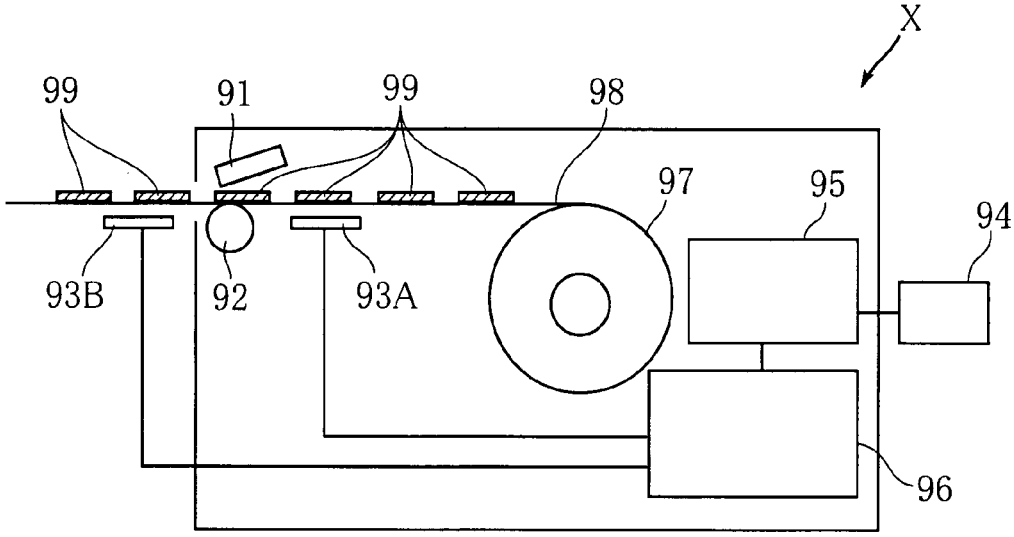
FIG.6 PRIOR ART
FIG. 6 illustrates an example of a conventional RFID tag printer.

According to the present embodiment, both the printing process and the data communication are performed by using the thermal printhead A1 only. In other words, there is no need to use e.g. a coil antenna as a data transmitter-receiver in addition to the thermal printhead A1. Accordingly, in the RFID tag printer P shown in FIG. 4, it is unnecessary to arrange the thermal printhead A1 in series with a plurality of coil antennas like the conventional system shown in FIG. 6. This is advantageous to the downsizing of the RFID tag printer P.

As shown in FIGS. 1 and 2, the providing of the coil antenna 3 on the substrate 1 enables the downsizing of the thermal printhead A1 itself, which contributes to the downsizing of the RFID tag printer P. Further, according to the present embodiment, the coil antenna 3 and the platen roller 62 do not interfere with each other.

Still further, since the coil antenna 3 is provided at the thermal printhead A1, the coil antenna 3 is brought close to the RFID tag T. Specifically, the thermal printhead A1 contacts the RFID tag T as a print target during the printing process. Thus, when the coil antenna 3 is provided at the thermal printhead A1, the coil antenna 3 is brought into a position close to the RFID tag T. As the coil antenna 3 is positioned closer to the RFID tag T, the RFID tag T passes through an area with higher magnetic intensity in the electromagnetic field EM. In this way, it is possible to prevent the magnetic intensity applied to the RFID tag T from becoming lower than the minimum operating magnetic intensity for the RFID tag T. With a high magnetic intensity, reliable and high-speed data communication is performed by the electromagnetic induction method. The illustrated coil antenna 3 is provided on the obverse surface 1*a* of the substrate 1, which ensures that the coil antenna 3 comes into direct facing relation to the RFID tag T.

The magnetic sheet 4 prevents the electromagnetic field EM from unduly extending below in FIG. 2. Thus, the electromagnetic field EM with a higher magnetic intensity extends upward in the figure. This also contributes to the attaining of reliable and high-speed data communication with the RFID tag T.

Figure 5:
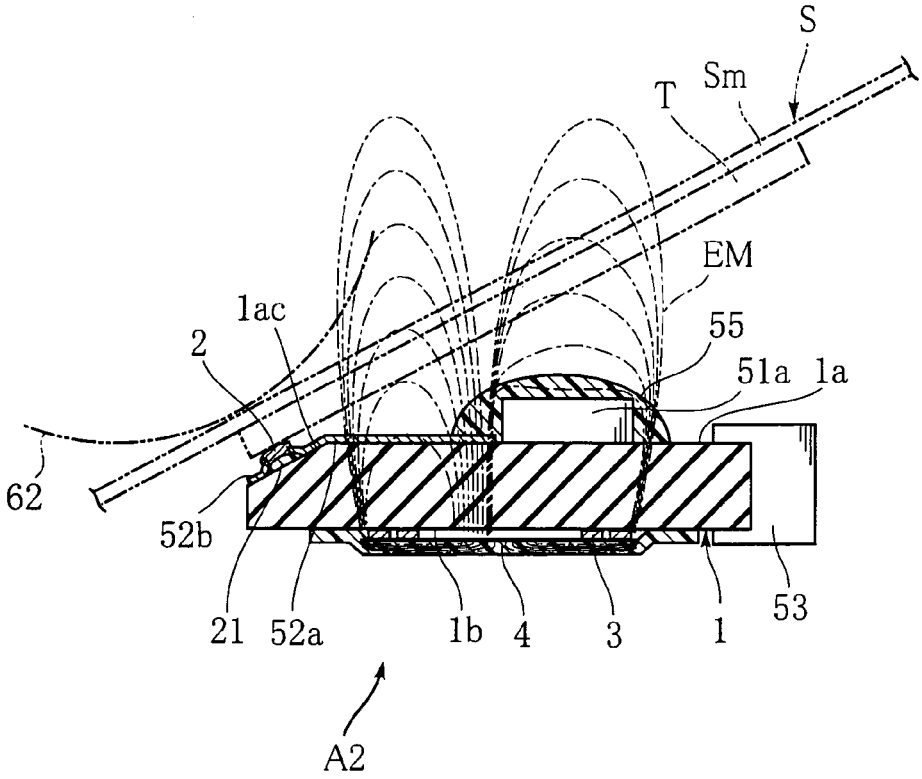
FIG. 5 is a sectional view illustrating a thermal printhead according to a second embodiment of the present invention.

FIG. 5 illustrates a thermal printhead according to a second embodiment of the present invention. In the figure, elements identical or similar to those of the above embodiment are indicated by the same reference numbers.

The thermal printhead shown in FIG. 5 is different from the above-described thermal printhead A1 of the first embodiment in that the coil antenna 3 is provided on the reverse surface 1*b* of the substrate 1. In the present embodiment, the coil antenna 3 is positioned closer to the heating resistors 2, toward the left in FIG. 2, than in the thermal printhead A1.

With such an arrangement, similarly to the above-described thermal printhead A1 of the first embodiment, the RFID tag printer provided with the thermal printhead A2 is made compact, while high-speed and reliable data communication with the RFID tag T is performed. Further, in the present embodiment, since the coil antenna 3 is provided on the reverse surface 1*b* of the substrate 1, the size of the substrate 1 can be smaller than that of the thermal printhead A1 shown in FIG. 2. Thus, the RFID tag printer provided with the thermal printhead A2 is advantageously downsized.

Still further, by positioning the coil antenna 3 near the heating resistors 2, the distance between the coil antenna 3 and the RFID tag T becomes further smaller. Thus, still higher magnetic intensity is applied to the RFID tag T by the electromagnetic field EM. This is advantageous to attaining reliable and high-speed data communication with the RFID tag T.

The thermal printhead and the thermal printer with wireless communication function according to the present invention are not limited to the above-described embodiments. Specific structures of the thermal printhead and the thermal printer with wireless communication function may be variously modified.

The position of the coil antenna in the thermal printhead is not limited to that in the above-described embodiments. For example, the coil antenna may be positioned on a substrate provided separately from the substrate on which the heating resistors are provided, and the two substrates may be combined together. In this case, a magnetic sheet may be provided between these substrates, so that the drive IC is protected from the influence of the electromagnetic field.

The number and arrangement of the heating resistors are not limited to the above-described embodiments. Further, the arrangement of the wirings for electrically conducting the heating resistors as well as the number of the drive IC for printing process are not limited to the above-described embodiments. For example, by providing a plurality of drive ICs, the number of the heating resistors is increased, which enables printing on a wider print target.

The above-described data communication is performed at a frequency of 13.56 MHz, so that the present invention is applied to an automatic detecting system which uses RFID tags and has a relatively high versatility. Alternatively, the frequency may be 135 kHz, for example, and the present invention may be applied to an automatic detecting system which uses RFID tags and operates at a frequency band different from that used in the present embodiment. Further, the wireless communication method is not limited to the electromagnetic induction method, and a radio wave at frequency band of 433 MHz, 900 MHz, or 2.445 GHz may be utilized. It is preferable in view of versatility, that the wireless communication in the present invention is performed with respect to RFID tags, but not limited to this. The RFID tags are not limited to tags for baggage management, and may include various tags used as admission cards of an exhibition, bookplates for collection management in a library, and non-contact type commutation tickets, for example. The print target is not limited to RFID tags, and any print target may be used if data communication by wireless communication is applicable.

The RFID tag printer may not be configured to perform both printing and data communication, and, according to a print target, the printer may perform the sending or receiving of data only or printing only at one time. The thermal printer with wireless communication function according to the present invention is not limited to an RFID tag printer.

The invention claimed is:

1. A thermal printhead for printing on a print target including a coil antenna and a memory, the printhead comprising:

an insulating substrate;

a plurality of heating resistors arranged on the substrate; and a data transmitter-receiver for transmitting and receiving data with respect to the print target by wireless communication;

wherein the data transmitter-receiver forms an integral part of the substrate.

2. The thermal printhead according to claim 1, wherein the data transmitter-receiver includes a coil antenna.

3. The thermal printhead according to claim 2, wherein the data transmitter-receiver further includes a drive IC for the coil antenna.

4. The thermal printhead according to claim 3, further comprising a connector disposed at an edge of the substrate, wherein the drive IC for the coil antenna is spaced apart from the connector in a longitudinal direction of the edge of the substrate.

5. The thermal printhead according to claim 2, wherein the print target comprises an RFID (Radio Frequency Identification) tag, the data transmitter-receiver being configured to perform data communication with the RFID tag.

6. The thermal printhead according to claim 2, further comprising a drive IC for the plurality of heating resistors, wherein the drive IC is disposed between the coil antenna and the plurality of heating resistors.

7. The thermal printhead according to claim 2, wherein the coil antenna is provided at the substrate.

8. The thermal printhead according to claim 7, wherein the coil antenna is provided on a surface of the substrate on which the heating resistors are provided.

9. The thermal printhead according to claim 7, wherein the coil antenna is provided on a surface of the substrate that is opposite to the surface provided with the heating resistors.

10. The thermal printhead according to claim 2, further comprising a magnetic sheet containing a magnetic substance.

11. The thermal printhead according to claim 10, wherein the magnetic substance is ferrite.

12. The thermal printhead according to claim 10, wherein the magnetic sheet is provided at a side reverse to a side facing the print target via the coil antenna.

13. A thermal printer with wireless communication function comprising the thermal printhead according to claim 1, wherein the thermal printer performs printing on the print target and data communication with respect to the print target.

14. The thermal printhead according to claim 1, wherein the substrate is formed with an inclined portion at one end thereof, and the plurality of heating resistors are disposed at the inclined portion.

15. The thermal printhead according to claim 14, wherein the substrate is inclined relative to the print target when printing is performed on the print target.

16. The thermal printhead according to claim 1, wherein the substrate comprises a solid plate.

* * * * *